US009726345B2

(12) United States Patent
Jang

(10) Patent No.: US 9,726,345 B2
(45) Date of Patent: Aug. 8, 2017

(54) LIGHTING MODULE AND LIGHTING APPARATUS HAVING THE SAME

(71) Applicant: LG INNOTEK CO., LTD., Seoul (KR)

(72) Inventor: Chul Ho Jang, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 273 days.

(21) Appl. No.: 14/527,238

(22) Filed: Oct. 29, 2014

(65) Prior Publication Data

US 2016/0040855 A1 Feb. 11, 2016

(30) Foreign Application Priority Data

Aug. 5, 2014 (KR) ..... 10-2014-0100419

(51) Int. Cl.

| | |
|---|---|
| ***F21V 7/06*** | (2006.01) |
| ***F21V 7/04*** | (2006.01) |
| ***F21V 29/74*** | (2015.01) |
| *F21W 131/103* | (2006.01) |
| *F21Y 113/00* | (2016.01) |
| *F21V 29/507* | (2015.01) |
| *F21V 29/89* | (2015.01) |
| *F21Y 103/10* | (2016.01) |
| *F21Y 115/10* | (2016.01) |

(52) U.S. Cl.

CPC ..... *F21V 7/06* (2013.01); *F21V 7/048* (2013.01); *F21V 29/74* (2015.01); *F21V 29/507* (2015.01); *F21V 29/89* (2015.01); *F21W 2131/103* (2013.01); *F21Y 2103/10* (2016.08); *F21Y 2113/00* (2013.01); *F21Y 2115/10* (2016.08)

(58) Field of Classification Search

CPC ..... F21V 5/04; F21V 17/06; F21V 17/164

See application file for complete search history.

(56) References Cited

U.S. PATENT DOCUMENTS

| | | | | |
|---|---|---|---|---|
| 9,297,514 | B2 * | 3/2016 | Roudeski | F21V 23/009 |
| 2010/0073932 | A1 * | 3/2010 | Zheng | F21K 9/00 362/249.06 |
| 2012/0147603 | A1 * | 6/2012 | Hochstein | F21V 29/004 362/247 |
| 2013/0010468 | A1 * | 1/2013 | Stoll | F21V 29/004 362/235 |
| 2013/0271980 | A1 * | 10/2013 | Quirion | F21V 31/00 362/235 |
| 2013/0294083 | A1 * | 11/2013 | Zheng | F21V 23/008 362/294 |
| 2014/0226328 | A1 * | 8/2014 | Schwarz | F21V 7/0008 362/235 |
| 2015/0241050 | A1 * | 8/2015 | Wilcox | F21V 15/015 362/249.02 |

* cited by examiner

*Primary Examiner* — Anabel Ton

(74) *Attorney, Agent, or Firm* — Birch, Stewart, Kolasch & Birch, LLP

(57) ABSTRACT

Disclosed is a lighting module including a bottom part including a bottom cover having a transmission hole, a top cover provided on the bottom cover and having a protrusion hole, a reflective cover disposed between the bottom cover and the top cover, and having a parabolic surface to reflect incident light to the transmission hole, a heat radiation plate having a heat radiation protrusion protruding through the protrusion hole of the top cover and provided on the top cover and a light source part provided on one surface of the heat radiation protrusion to emit light into the reflective cover.

20 Claims, 21 Drawing Sheets

| | Intensity slices |
|---|---|
| Comparative example |   |
| Embodiment |   |

| | Coeff. Of Utiliz.(CU) Graph |
|---|---|
| Comparative example |  |
| Embodiment |  |

| | Luminaire Classification System(LCS) Graph |
|---|---|
| Comparative example |   |
| Embodiment |   |

LIGHTING MODULE AND LIGHTING APPARATUS HAVING THE SAME

CROSS-REFERENCE TO RELATED. APPLICATIONS

The present application claims priority under 35 U.S.C. §119(a) of Korean Patent Application No. 10-2014-0100419 filed on Aug. 5, 2014, which is hereby incorporated by reference in its entirety.

BACKGROUND

The embodiment relates to a lighting module and a lighting apparatus having the same.

In general, if a lighting apparatus employing a light emitting device is turned on, high-temperature heat is emitted. A lamp chamber is heated by the heat, so that the lifespan of the lamp and various parts to support the lamp may be degraded. For example, regarding a street lamp, if the street lamp is overheated, the street lamp is turned off above at a predetermined temperature through a control operation to prevent the failure of the street lamp. However, the situation that the street lamp is turned off refers to that the street lamp does not perform the inherent function thereof, which becomes a problem in itself.

In particular, when the street lamp is manufactured by using a light emitting diode (LED) that is recently spotlighted as a high-efficiency light source, the improvement in a heat radiation structure is significantly required to efficiently radiate heat generated from the LED.

Further, even if a conventional street lamp employs the LED, a globe is installed on the street lamp to cover the entire portion of the street lamp in a circular shape similarly to that of a conventional mercury or sodium street lamp, so that the heat radiation may be difficult. In addition, the conventional street lamp is regimentally installed without taking into consideration optical characteristics necessary for the installation place thereof; for example a distribution characteristic, luminance, and the degree of uniformity of light. Further, pollution may be increased by light irradiated rearward from the street lamp. Accordingly, the development of a novel LED lighting apparatus capable of solving the above problems is increasingly required.

SUMMARY

The embodiment provides a lighting module capable of reducing light deviating from a lighting area.

The embodiment provides a lighting module having a reflective cover to reflect light incident thereto from a light source to a lighting area by distributing the light.

The embodiment provides a lighting module capable of radiation of heat emitted from a light source through a heat radiation plate exposed to an outside.

The embodiment provides a lighting apparatus having a plurality of lighting modules.

According to the embodiment, there is provided a lighting module including a bottom part including a bottom cover having a transmission hole, a top cover provided on the bottom cover and having a protrusion hole, a reflective cover disposed between the bottom cover and the top cover, and having a parabolic surface to reflect incident light to the transmission hole, a heat radiation plate having a heat radiation protrusion protruding through the protrusion hole of the top cover and provided on the top cover, and a light source part provided on one surface of the heat radiation protrusion to emit light into the reflective cover.

According to the embodiment, there is provided a lighting module including a light source part including a printed circuit board and a plurality of light emitting devices to emit light on the printed circuit board, and a reflective cover provided at a rear portion thereof with the light source part to reflect light incident from the light source part downward. The reflective cover includes a first reflective surface including a plurality of first sub-reflective surfaces having mutually different radiuses at a first area adjacent to an optical axis of the light emitting device, a second reflective surface including a plurality of second sub-reflective surfaces having mutually different radiuses at a second area adjacent to the optical axis, a separation part disposed between the first and second reflective surfaces while extending in a direction of the optical axis, and a third reflective surface having a plurality of third sub-reflective surfaces at outer portions of the first and second reflective surfaces.

DETAILED DESCRIPTION OF THE EMBODIMENTS

Hereinafter, a lighting module having a heat radiation structure or a lighting apparatus according to the embodiment will be described with reference to accompanying drawings. In the following description of embodiments of the present invention, if the detailed description of generally-known functions or configurations may make the subject matter of the present invention unclear, the detailed description of the generally-known functions and configurations will be omitted. In addition, terminologies used in the following description are defined based on functions of the present invention, and may be varied depending on the intents of a user or an operator, or a custom. Accordingly, the terminologies should be defined based on the overall contents of the specification. In addition, those skilled in the art should understand that the following embodiment does not limit the scope of accompanying claims, but provided for the illustrative purpose, and various embodiments can be realized based on the technical spirits of the embodiment. In the following description of the embodiments, it will be understood that, when a layer (or film), a region, a pattern, or a structure is referred to as being "on" or "under" another substrate, another layer (or film), another region, another pad, or another pattern, it can be "directly" or "indirectly" on the other substrate, layer (or film), region, pad, or pattern, or one or more intervening layers may also be present. Such a position of the layer has been described with reference to the drawings.

Hereinafter, an exemplary embodiment will be described in more detail with reference to accompanying drawings. Meanwhile, the terminologies "lighting module" or "lighting apparatus" used in the following embodiment collectively refer to devices similarly to a street lamp, various lamps, an electronic display, and a headlamp used to outdoors.

Figure 1:
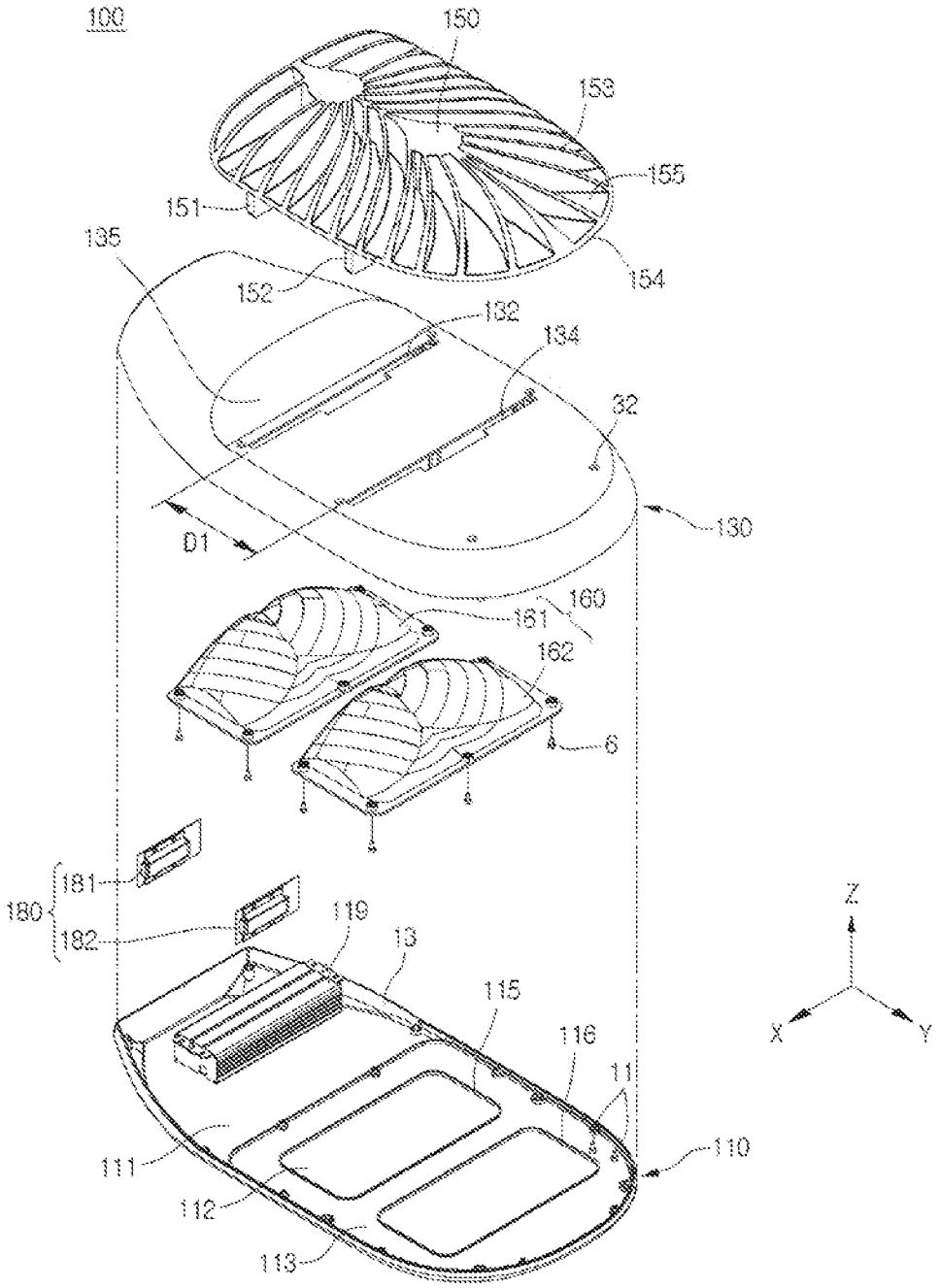
FIG. 1 is an exploded perspective view showing a lighting module according to the embodiment.
Figure 2:
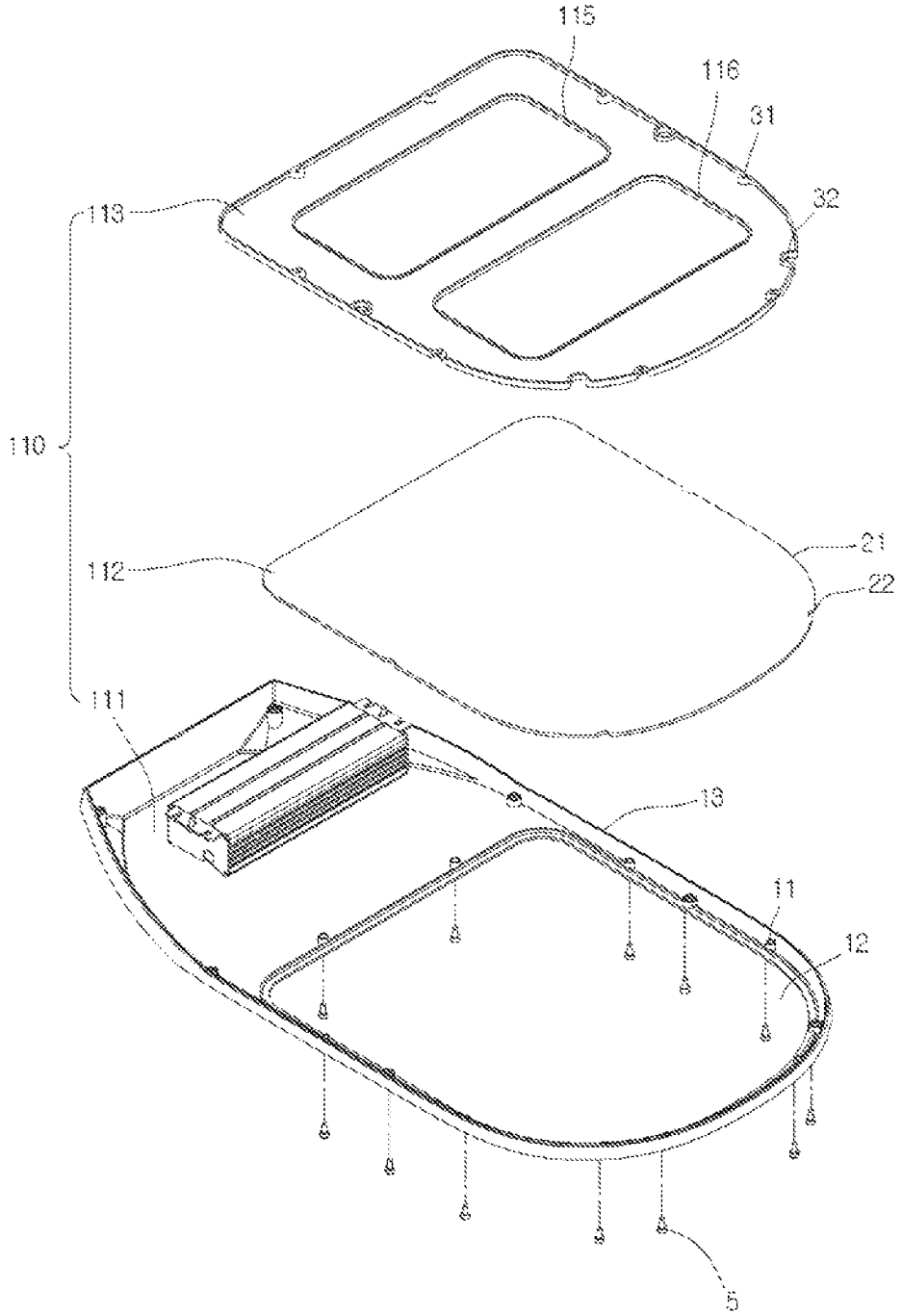
FIG. 2 is an exploded perspective view showing a bottom part in the lighting module of FIG. 1.
Figure 3:
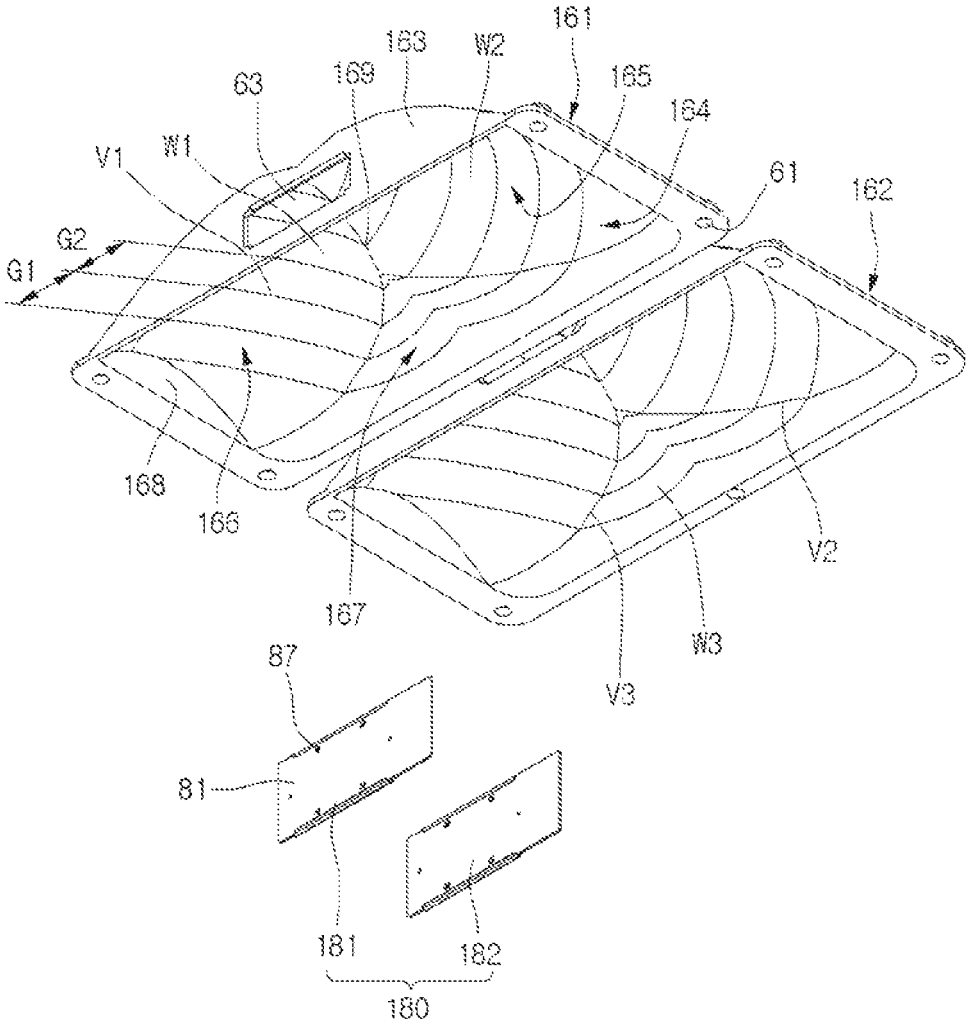
FIG. 3 is a view showing a light source part and a reflective cover in the lighting module of FIG. 1.
Figure 4:
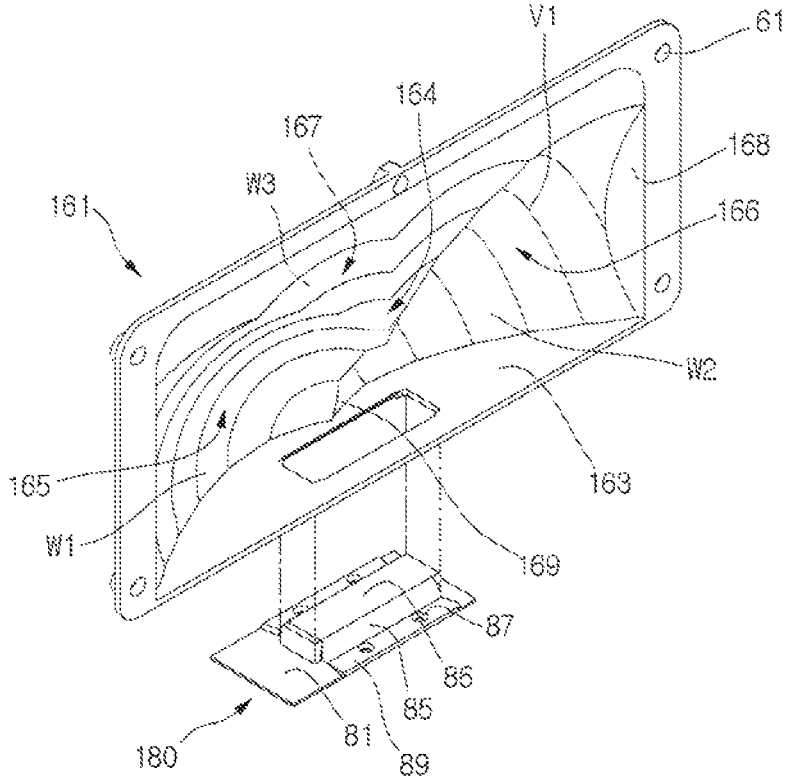
FIG. 4 is an exploded perspective view showing the light source part and the reflective cover of FIG. 3.
Figure 5:
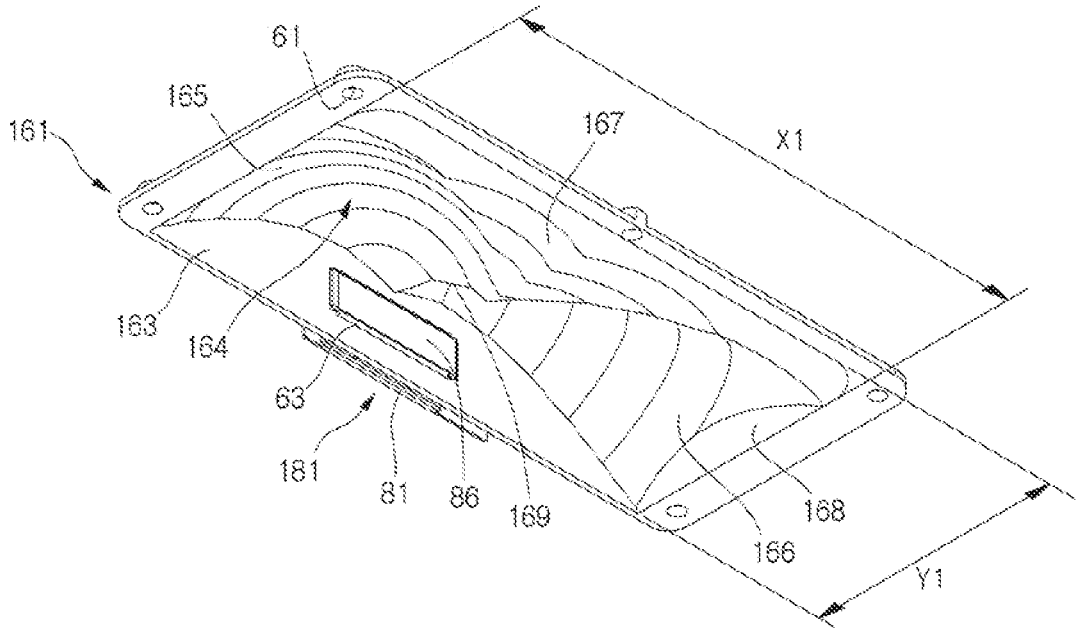
FIG. 5 is a view showing a reflective cover assembled with the light source part of FIG. 4.
Figure 6:
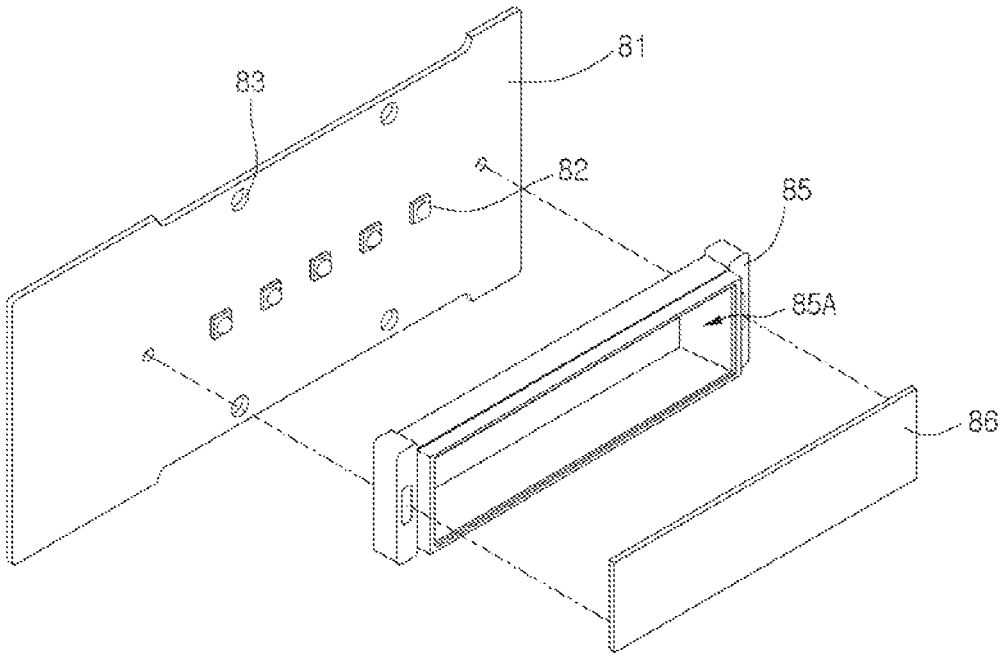
FIG. 6 is an exploded perspective view showing the light source part of FIG. 4.
Figure 7:
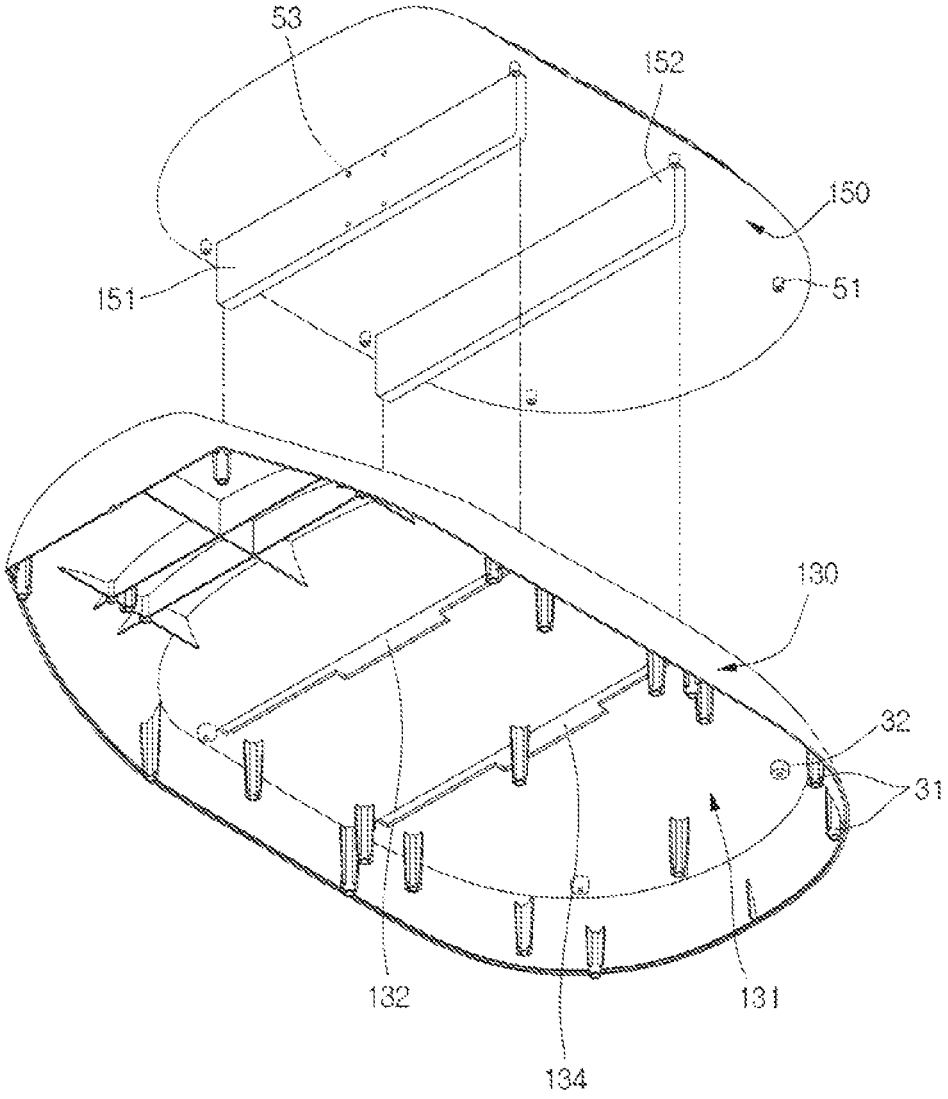
FIG. 7 is an exploded perspective view showing a top cover and a heat radiation plate in the lighting module of FIG. 1.
Figure 8:
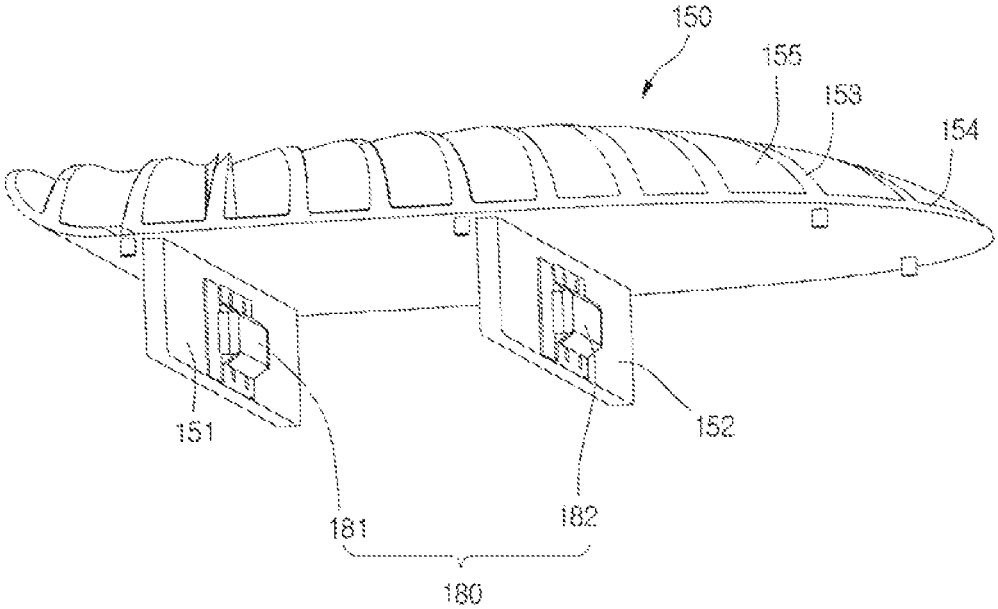
FIG. 8 is a perspective view showing an example in which the light source part is assembled with the heat radiation palate in the lighting module of FIG. 1.
Figure 9:
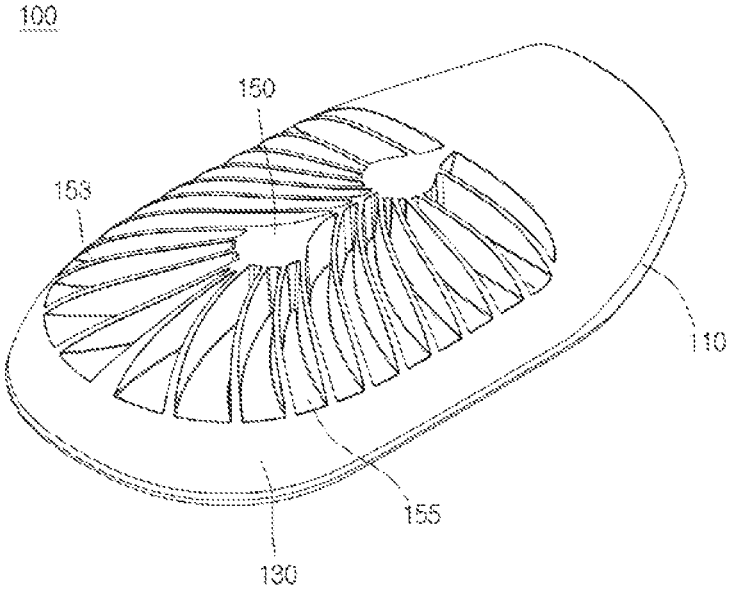
FIG. 9 is an assembling perspective view showing the lighting module of FIG. 1.
Figure 10:
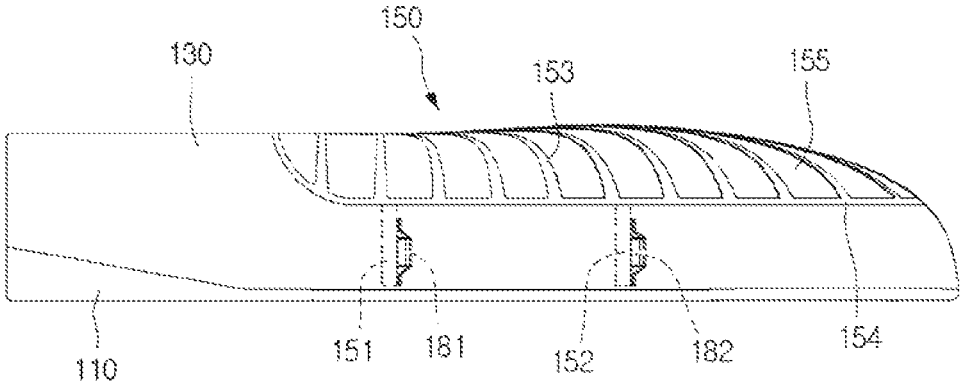
FIG. 10 is a partial perspective view showing the light source part in the lighting module of FIG. 9.

FIG. 1 is an exploded perspective view showing a lighting module according to the embodiment. FIG. 2 is an exploded perspective view showing a bottom part in the lighting module of FIG. 1. FIG. 3 is a view showing a light source part and a reflective cover in the lighting module of FIG. 1. FIG. 4 is an exploded perspective view showing the light source part and the reflective cover of FIG. 3. FIG. 5 is a view showing a reflective cover assembled with the light source part of FIG. 4. FIG. 6 is an exploded perspective view showing the light source part of FIG. 4. FIG. 7 is an exploded perspective view showing a top cover and a heat radiation plate in the lighting module of FIG. 1. FIG. 8 is a perspective view showing an example in which the light source part is assembled with the heat radiation palate in the lighting module of FIG. 1. FIG. 9 is an assembling perspective view showing the lighting module of FIG. 1. FIG. 10 is a partial perspective view showing the light source part in the lighting module of FIG. 9.

Referring to FIGS. 1 to 10, a lighting module 100 includes a bottom part 110, a light source part 180 and a reflective cover 160 provided on the bottom part 110, a top cover 130 provided on the reflective cover 160, and a heat radiation plate 150 provided on the top cover 130.

As shown in FIG. 2, the bottom part 110 includes a bottom cover 111 having a transmission hole 12 formed in a portion thereof, a transparent cover 112 provided on the transmission hole 112, and a guide cover 113 provided on the transparent cover 112 and having guide holes 115 and 116.

The bottom cover 111 may be formed of plastic or a metallic material. The transmission hole 12 is provided in an internal area of the bottom cover 111 corresponding to the transparent cover 112. The transmission hole 12 has a size smaller than that of the transparent cover 112 to prevent the transparent cover 112 from being disassembled downward. The bottom cover 111 may be provided at a top rear portion thereof with a power module 119. The power module 119 supplies power into the lighting module.

A plurality of bosses 11 are provided at a peripheral portion of the transmission hole 12 of the bottom cover 111. The bosses 11 have holes through which coupling units 5 pass. The coupling units 5 may include screws or pins. In addition, the transparent cover 112 may be coupled to the bottom cover 111 by using a member, such as an adhesive agent, in addition to the coupling unit. An edge 13 of the bottom cover 111, which protrudes toward the top cover 130, may cover an outer portion of the boss 11.

The transparent cover 112 includes glass or a transmissive material to diffuse incident light to be irradiated. The transparent cover 112 has insertion grooves 22 provided along an edge 21 and coupled to the bosses 11 of the bottom cover 111, respectively, and the insertion grooves 22 may be coupled to the bosses 11, respectively. Therefore, an outer portion of the transparent cover 112 may be coupled to a peripheral portion of the transmission hole 12 of the bottom cover 111.

The guide cover 112 is disposed between the reflective cover 160 and the transparent cover 112 and has a plurality of coupling holes 31 and insertion holes 32 coupled to the bosses 11 of the bottom cover 111. A coupling unit 5, which passes through the boss 11, is coupled to the coupling hole 31, and a portion of the bosses 11 may be inserted into the insertion hole 32.

The guide cover 113 includes the guide holes 115 and 116 which are spaced apart from each other. The guide holes 115 and 116 may correspond to reflective covers 160, respectively. As the guide holes 115 and 116 are spaced apart from each other, the guide holes 115 and 116 guide light reflected from the mutually different reflective covers 160, respectively.

Referring to FIGS. 1, and 3 to 6, a plurality of light source parts 180, 181, and 182 may be provided. Each of the light source parts 180, 181, and 182 may be coupled to each of the reflective covers 160, 161, and 162, and one surface of each of heat radiation protrusions 151 and 152 of the heat radiation plate 150. Each light source part 180 may be coupled to a coupling hole 63 provided in a rear portion of the reflective cover 160 and fixed to the heat radiation protrusions 151 and 152, respectively.

As shown in FIG. 4, the light source part 180 includes a substrate 81, a plurality of light emitting devices 82, a guide case 85, and a diffusion plate 86. For example, the substrate 81 may include a printed circuit board (PCB). For example, the PCB may include at least one of a resin material PCB, a metal core PCB (MCPCB), and a flexible PCB (FPCB). For example, the PCB may include a MCPCB for the purpose of heat radiation.

The substrate 81 may be provided therein with coupling holes 83 for the coupling of the light source part 180. The coupling holes 83 of the substrate 81 may be coupled to the coupling holes 53 of the heat radiation protrusions 151 and 152 of the heat radiation plate 150 shown in FIG. 7 through coupling units (not shown). In addition, the substrate 81 shown in FIG. 4 may be provided thereon with a coupling rib 89 having coupling holes 87 corresponding to the coupling holes 83 of the substrate 81. The coupling rib 89 spaces the substrate 81 apart from the reflective cover 160 to electrically protect the substrate 81. The coupling rib 89 may be formed of an insulating material such as plastic.

At least one light emitting device 82 may be provided on the substrate 81 as shown in FIG. 6. For example, a plurality of light emitting devices 82 may be provided. The light emitting devices 82 may be provided in one row or two rows, but the embodiment is not limited thereto. The light emitting device 82 provided in the form of a package in which a light emitting chip is packaged may include an optical lens. The light emitting chip may emit at least one blue, red, green, and white lights and a UV (Ultraviolet) light. For example, the light emitting chip may emit white light for a lighting purpose. The light emitting device 82 may be disposed in the form of a chip on the substrate 81, but the embodiment is not limited thereto.

The guide case 85 is provided on the substrate 81 and provided therein with an insertion hole 85A, and the light emitting device 82 is inserted into the insertion hole 85A. The insertion hole 85A reflects light emitted from a peripheral portion of the light emitting device 82 to guide the light to the reflective cover 160. The insertion hole 85A may have a polygonal shape, a circular shape, or an oval shape. A diffusion plate 86 is provided on the guide case 85, and the diffusion plate 86 diffuses light extracted through the insertion hole 85A and irradiates the light through the reflective cover 160. The light emitted from the light source parts 181 and 182 is incident into the reflective covers 160, 161, and 162 and reflected to a lighting area.

Referring to FIGS. 3 to 5, and FIGS. 12 to 15, the reflective covers 160 (161 and 162) include at least one reflective cover, for example the first and second reflective covers 161 and 162. The first and second reflective covers 161 and 162 may be arranged at front/rear sides or left/right sides as shown in FIG. 1. In addition, the first and second reflective covers 161 and 162 may be arranged in n rows and m columns (wherein, $n \geq 2$, $m \geq 2$, the m and n are an integral number), but the embodiment is not limited thereto. In this case, the front-rear direction may be an optical axis direction (e.g., Y axis direction) which is an exit direction of light emitted from the light source part 180, and the left-right direction may be a direction normal to the optical axis direction.

Each of the first and second reflective covers 161 and 162 include a rear sidewall 163 provided at a rear portion thereof and coupled to the light source part 180, a recess 164 that is convex up, first and second reflective surfaces 165 and 166 symmetrically to each other in the recess 164, a third reflective surface 167 disposed between the first and second reflective surfaces 165 and 166, and a separation part 169 disposed between the first and second reflective surfaces 165 and 166. The first and second reflective covers 161 and 162 are disposed between the bottom part 110 and the top cover 130, have parabolic surfaces, and reflect light incident from the light source parts 181 and 182 toward the transmission hole 12.

As shown in FIG. 5, a width Y1 of the recess 164 of the reflective cover 160 may be less than a length X1. In other words, light diffusion effect may be increased in the left-right direction due to the length X1 of the recess 164 of the reflective cover 160, and the light may be irradiated with straightness toward a front side due to the width Y1. The diffusion area of light irradiated in the left-right direction may be adjusted due to the length X1, and an amount of light irradiated with the straightness toward the front side may be adjusted due to the width Y1. The front side direction may be a street side (SS) which is a road side in the case of a street lamp.

The first and second reflective surfaces 165 and 166 may be formed in shapes symmetrically to each other about the optical axis direction (Y axis direction of FIG. 1) of the light source parts 181 and 182. The first and second reflective surfaces 165 and 166 may be arranged at left/right areas of the separation part 169 and include a plurality of sub-reflective surfaces W1 and W2 therein. The sub-reflective surfaces W1 and W2 may be formed in the shape of a parabolic surface having a predetermined curvature. In other words, the first and second reflective surfaces 165 and 166 may have the shape of a parabolic surface. The parabolic surfaces of each of the reflective covers 161 and 162 are symmetrical to each other at both side areas of the optical axis direction (e.g., Y axis direction) of the light source parts 181 and 182. For example, the parabolic surfaces of each of the reflective covers 161 and 162 may be line symmetrical to each other. For example, the first and second reflective surfaces 165 and 166 may be provided at areas adjacent to the optical axis.

In an area disposed between the sub-reflective surfaces W1 and W2 inflection points V1 may be provided, and the inflection points V1 may form an inflection line along the area between the two sub-reflective surfaces W1 and W2. The sub-reflective surfaces W1 and W2 may be arranged with the same width (G1=G2) or arranged with mutually different widths (G1≠G2). The widths G1 and G2 of the sub-reflective surfaces W1 and W2 may be intervals between the inflection points V1. In this case, the mutually different widths (G1≠G2) may be gradually narrowed as the widths G1 and G2 of the sub-reflective surfaces W1 and W2 are farther away from the light source parts 180 (181 and 182). The widths G1 and G2 of the sub-reflective surfaces W1 and W2 may be formed in such a manner that curvatures of the sub-reflective surfaces W1 and W2 are more reduced as the sub-reflective surfaces W1 and W2 are farther away from the light source part 180 (181 and 182). Accordingly, the sub-reflective surfaces W1 and W2 can more diffuse light as the sub-reflective surfaces W1 and W2 are farther away from the light source parts 180 (181 and 182), so that light irradiated toward the front side can be uniformly distributed. In addition, the sub-reflective surfaces W1 and W2 may be arranged in the shape of a semicircle at an area between the separation part 169 and the rear sidewall 163. The sub-reflective surfaces W1 and W2 may have the shapes of semicircles having the same center at the light source part 180 and having different radiuses. The sub-reflective surfaces W1 and W2 may have surface areas gradually widened as the sub-reflective surfaces W1 and W2 are farther away from the light source part 180. Accordingly, the sub-reflective surfaces W1 and W2 reflect light with surface areas gradually widened as the sub-reflective surfaces W1 and W2 are farther away from the light source parts 180 (181 and 182), so that the light irradiated toward the front side can be uniformly distributed. The first and second reflective surfaces 165 and 166 may divide the light emitted from the light source part 180 to left/right areas and irradiate the light downward. The sub-reflective surfaces W1 and W2 of the first and second reflective surfaces 165 and 166 are provided at the light exit side of the light source part 180 to reflect the light to the lighting area, thereby preventing light from progressing in a direction of deviating from the lighting area, for example in a rear direction. The sub-reflective surfaces W1 and W2 may have the same curvature or mutually different curvatures, but the embodiment is not limited thereto.

The separation part 169 between the first and second reflective surfaces 165 and 166 serves as a boundary between mutually different reflective areas provided between the first and second reflective surfaces 165 and 166. The separation part 169 may uniformly diffuse the light in the left-right direction. In addition, the separation part 169 is provided higher than the top surfaces of the light sources parts 181 and 182 to prevent the interference of a light path. The separation part 169 may be provided lower than apexes of the first and second reflective surfaces 165 and 166. Accordingly, the light emitted from the light source part 180 can be uniformly distributed to the first and second reflective surfaces 165 and 166 due to the separation part 169 without the light loss.

The third reflective surface 167 extends from the separation part 169 and is provided at an outer area between the first and second reflective surfaces 165 and 166. The third reflective surface 167 is provided at a front side of the separation part 169, and includes a plurality of sub-reflective surfaces W3 provided with a predetermined curvature at both side areas of the separation part 169.

Figure 12:
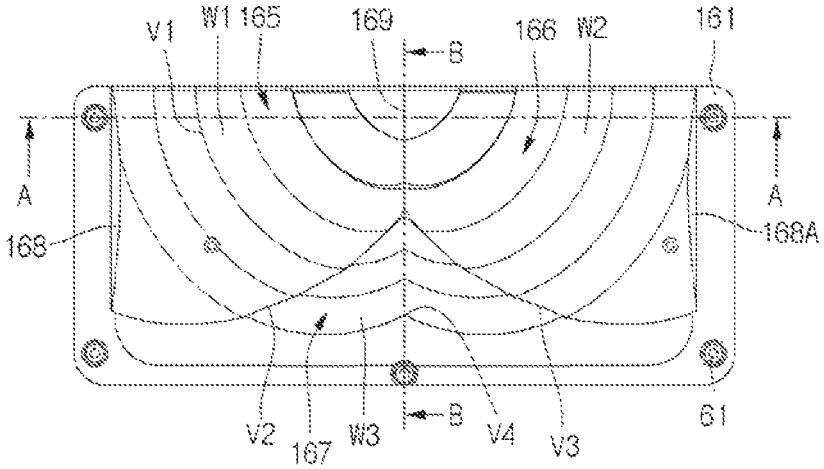
FIG. 12 is a bottom view showing the reflective cover of FIG. 1.
Figure 13:
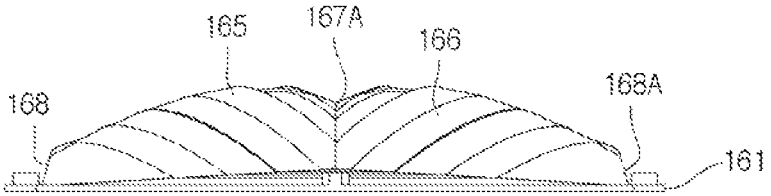
FIGS. 13 and 14 are a front view and a side view showing the reflective cover of FIG. 9.
Figure 14:
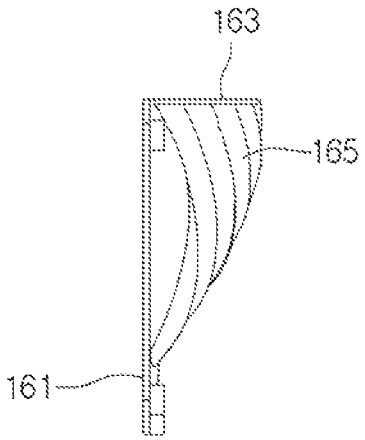

The sub-reflective surface W3 of the third reflective surface 167 may have a curvature different from curvatures of the sub-reflective surfaces W1 and W2 of the first and second reflective surfaces 165 and 166. For example, the sub-reflective surface W3 of the third reflective surface 167 may have a curvature greater than the curvatures of the sub-reflective surfaces W1 and W2 of the first and second reflective surfaces 165 and 166. Accordingly, since the third reflective surface 167, which has beam angle distribution different from that of the first and second reflective surfaces 165 and 166, irradiates light in the left-right direction at the front side, the degree of the uniformity of light can be generally improved. As the third reflective surface 167 is farther away from the light source part 180, the surface area of the sub-reflective surface W3 may be gradually widened. Referring to FIG. 12, a center area V4 linearly extending from an extension line of the separation part 169 in an area of the third reflective surface 167 may be positioned lower than the surface of the left/right sub-reflective surfaces V3, and may be an inflection line between the left/right sub-reflective surfaces V3. The center area V4 may be gradually lowered as the center area V4 is farther away from the light source part and extend to a bottom surface of the reflective cover 160. The third reflective surface 167 may have a shape which is bilaterally symmetrical to each other about the center area V4.

A boundary area V2 between the first and third reflective surfaces 165 and 167 branches in the form of a curve from the separation part 169, and the boundary area V3 between the second reflective surface 166 and the third reflective surface 168 branches in the form of a curve from the separation part 169. The boundary area V2 between the third and first reflective surfaces 167 and 165 may be a first inflection line extending from the separation part 169, and the first inflection line may extend to a first blocking wall 168 from the separation part 169 while forming a curved line. The boundary area V3 between the third and second reflective surfaces 167 and 166 may be provided therein with a second inflection line extending from the separation part 169. The second inflection line may extend from the separation part 169 to a second blocking wall 168A while forming a curved line. Each sub-reflective surface W3 of the third reflective surface 167 may be inflected from each of the sub-reflective surfaces W1 and W2 of the first and second reflective surfaces 165 and 166 while extending.

In the boundary area V1 among the sub-reflective surfaces W1, W2, and W3, points, in which the sub-reflective surfaces W1, W2, and W3 of the first to third reflective surfaces 165, 166, and 168 are inflected, may be provided. Therefore, the light reflection efficiency can be improved by the sub-reflective surfaces W1, W2, and W3. The third reflective surface 167 can improve the straightness of light other than light diffused to the first and second reflective surfaces 165 and 166.

The first and second blocking walls 168 and 168A may be provided at both side areas of the recess 164 of the reflective cover 160, and each of the first and second blocking walls 168 and 168A may have a semi-circular contour line. The first and second blocking walls 168 and 168A may have surfaces inclined to or perpendicular to the bottom surface of the reflective cover 160. The first blocking wall 168 may be provided at an outer portion of the first reflective surface 165 to reflect light. The second blocking wall 168A may be provided at an outer portion of the second reflective surface 166 to reflect light. The first and second blocking walls 168 and 168A face each other and are bent from the first and second reflective surfaces 165 and 166.

The first to third reflective surfaces 165, 166 and 167 of the reflective cover 160 may be further provided thereon with reflective layers. The reflective layers include a metallic material. The reflective cover 160 may be formed of a plastic material or a metallic material, but the embodiment is not limited thereto.

Figure 15A:
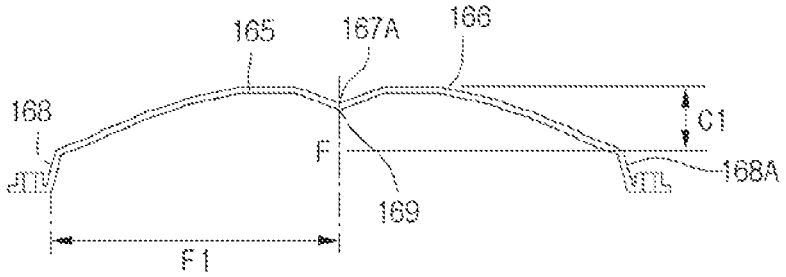
FIGS. 15A and 15B are sectional views taken along lines A-A and B-B of the reflective cover of FIG. 12.
Figure 15B:
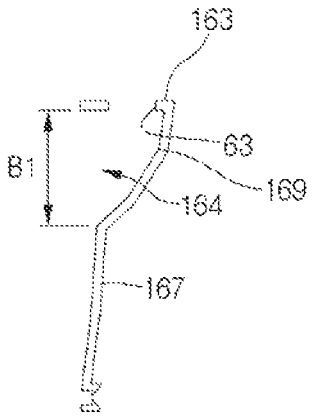

Referring to FIGS. 15A and 15B, the reflective covers 160 (161 and 162) are provided at upper portions thereof with concave grooves 167A, and the concave grooves 167A are positioned in opposition to the separation part 169. The concave grooves 167A are arranged lower than apexes of the first and second reflective surfaces 165 and 166 to lower the position of the separation part 169. Since the separation part 169 is positioned above an origin F in which the light source part is positioned, the incident light can be effectively reflected and diffused by the first and second reflective surfaces 165 and 166 provided at left/right side areas. Since a length F1 of each of the first and second reflective surfaces 165 and 166 may be longer than a width B1, light may be concentrated downward, that is, at the street side in a lighting lamp such as a street lamp and may reduce leaking light deviating from the street side. The length F1 and the width B1 may be varied depending on the sizes of the reflective covers 161 and 162, but the embodiment is not limited thereto. Since the apexes of the first and second reflective surfaces 165 and 166 is provided at a predetermined distance C1 higher than the origin F in which the light source part is positioned, light loss may be reduced in the first and second reflective surfaces 165 and 166, and the reflection efficiency of the light reflected downward from the first and second reflective surfaces 165 and 166 can be increased.

As shown in FIG. 3, a plurality of coupling holes 61 are provided in the reflective cover 169, and the coupling hole 61 may be coupled to the coupling unit 6 shown in FIG. 1.

Referring to FIG. 7, the reflective cover 160 is coupled to a first receiving area 131 provided at a lower portion of the top cover 130. The first receiving area 131 is provided therein with the reflective cover 160 and a plurality of bosses 31. The coupling unit 6 may be coupled to the boss 31 through the coupling hole 61 of the reflective cover 160 shown in FIGS. 1 and 6. Accordingly, the top cover 130 and the reflective cover 160 may be coupled to the bottom cover 111. The coupling hole 32 is provided in the top cover 130. The coupling hole 31 may be coupled to the coupling hole 51 of the heat radiation plate 150 through a coupling unit (not shown). Accordingly, the heat radiation plate 150 may be tightly fixed to the upper portion of the top cover 130. A second receiving area 135 at an upper portion of the top cover 130 may have a step structure so that the bottom surface of the heat radiation plate 150 may tightly make contact with the second receiving area 135. The second receiving area 135 of the top cover 130 may have a shape corresponding to a shape of the bottom surface of the heat radiation plate 150.

The top cover 130 includes at least one of protrusion holes 132 and 134, and the heat radiation protrusions 151 and 152, which protrude downward from the heat radiation plate 150, are inserted into the protrusion holes 132 and 134. The protrusion holes 132 and 134 may be spaced apart from each other.

The heat radiation plate 150 is provided at the lower portion thereof with at least one of the heat radiation protrusions 151 and 152, for example a plurality of heat radiation protrusions 151 and 152. The heat radiation protrusions 151 and 152 may protrude out of the lower receiving area 131 of the top cover 130 through the protrusion holes 132 and 134 of the top cover 130, respectively. The heat radiation protrusions 151 and 152 may be provided at a rear portion of the light source part 180 (181 and 182) while making contact with the substrate 81. The heat radiation protrusions 151 and 152 may be spaced apart from each other. Therefore, the heat radiation plate 150 may be coupled to the upper portion of the top cover 130. If the top cover 130 is coupled to the heat radiation protrusions 151 and 152 of the heat radiation plate 150, the top cover 130 may make contact with the bottom surface of the heat radiation plate 150, but the embodiment is not limited thereto.

The substrate 81 of the light source part 180 shown in FIGS. 4 and 6 is coupled to one surface of the heat radiation protrusions 151 and 152. A plurality of coupling holes 53, which are provided in the heat radiation protrusions 151 and 152, may be coupled to the substrate 81 by coupling units (not shown) passing through the substrate 81. Accordingly, as shown in FIGS. 8 and 10, the light source part 180 (181 and 182) may be coupled to the heat radiation protrusions 151 and 152, respectively. In this case, after coupling the light source part 180 (181 and 182) to the heat radiation protrusions 151 and 152 of the heat radiation plate 150, the heat radiation protrusions 151 and 152 may be inserted into the protrusion holes 132 and 134 of the top cover 130. According to another example, after the heat radiation protrusions 151 and 152 of the heat radiation plate 150 have been inserted into the protrusion holes 132 and 134 of the top cover 130, the light source parts 180 (181 and 182) may be coupled to the heat radiation protrusions 151 and 152. The light source parts 180 (181 and 182) are coupled to the heat radiation protrusions 151 and 152 and may protrude through the coupling holes 63 of the reflective covers 160 (161 and 162).

Referring to FIG. 1 and FIGS. 8 to 10, the heat radiation plate 150 is coupled to the upper portion of the top cover 130. The heat radiation plate 150 includes a base part 154 provided at a lower portion thereof and a plurality of heat radiation fins 153 provided at an upper portion thereof. The heat radiation fins 153 may have a width reduced toward the center of the heat radiation plate 150. Accordingly, the heat radiation plate 150 may represent heat radiation efficiency more improved toward the central portion of the heat radiation fin 153. In addition, the central portions of the heat radiation fins 153 may be connected with each other, so that a heat radiation surface area and heat radiation efficiency can be improved. A groove 155 between the heat radiation fins 153 may have a depth gradually reduced toward the central portion of the heat radiation plate 150, and a thickness of the base part 154 of the heat radiation plate 150 may be gradually reduced toward an outer portion from the central portion. Accordingly, the central portion of the base part 154 of the heat radiation plate 150 can rapidly radiate conducted heat, and the heat can be diffused through the peripheral portion of the heat radiation plate 150. Since the heat radiation plate 150 is exposed to the outside, the heat radiation efficiency can be maximized. The top cover 130 may be formed of a material the same as that of the heat radiation plate 150. For example, the top cover 130 may include aluminum (Al) or an Al containing alloy. According to another example, the top cover 130 may be formed integrally with the heat radiation plate 150.

Referring to FIG. 1 and FIGS. 8 and 9, in the lighting module, the light source part 180 may be coupled to the heat radiation protrusions 151 and 152 of the heat radiation plate 150 between the bottom cover 111 and the top cover 130, the heat radiation protrusions 151 and 152 may protrude through the protrusion holes 132 and 134 of the top cover 130, and the light source part may be coupled to the reflective cover 160. In addition, the bottom cover 110 is assembled with the top cover 130 to provide a module shown in FIGS. 9 and 10. The light emitted from the reflective cover 160 may be extracted downward through the transparent cover 112. The heat emitted from the light source part 180 may be diffused and radiated by the heat radiation protrusions 151 and 152 and the heat radiation fin 153 of the heat radiation plate 150. The light emitted by the first and second reflective surfaces 165 and 166 of the reflective cover 160 may be diffused in the left-right direction and irradiated downward, and light reflected beyond the lighting area, for example light leaking in a rear direction, may be removed. In this case, the rear direction may be a negative Y axis direction.

Figure 11:
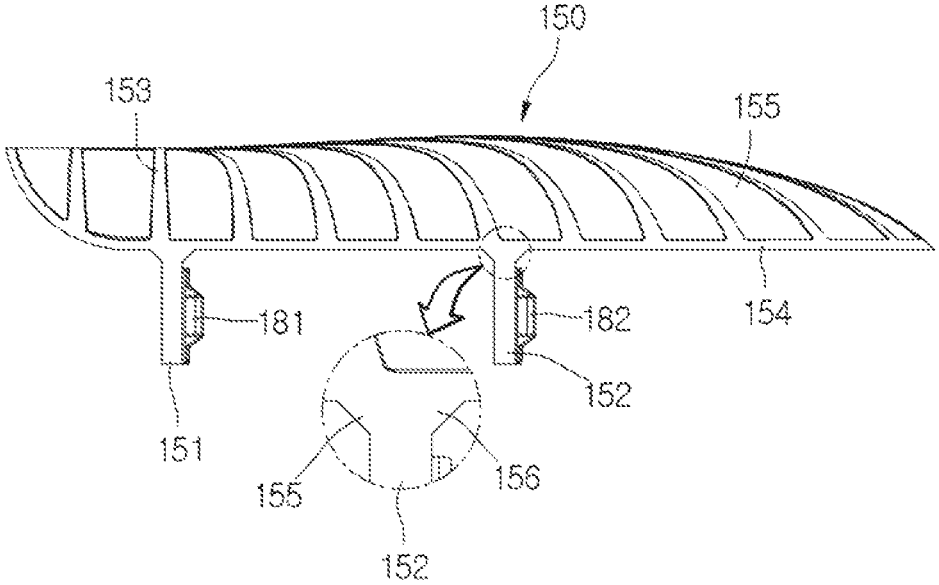
FIG. 11 is a view showing another example of the heat radiation plate of FIG. 8.

As shown in FIG. 11, the heat radiation protrusions 151 and 152 of the heat radiation plate 150 increase the areas of connection parts 151A and 152A with the base part 154, so that the heat conducted from the heat radiation protrusions 151 and 152 can be effectively conducted through the base part 154. The connection parts 151A and 152A with the base part 154 in the heat radiation protrusions 151 and 152 may have a width wider than that of other areas. Accordingly, the heat radiation efficiency can be improved by the heat radiation protrusions 151 and 152 connected to the base part 154, and a light emitting device can be protected from heat emitted from the light source part 180.

Hereinafter, the detailed structure of the reflective cover 160 according to the embodiment will be described.

Figure 16:
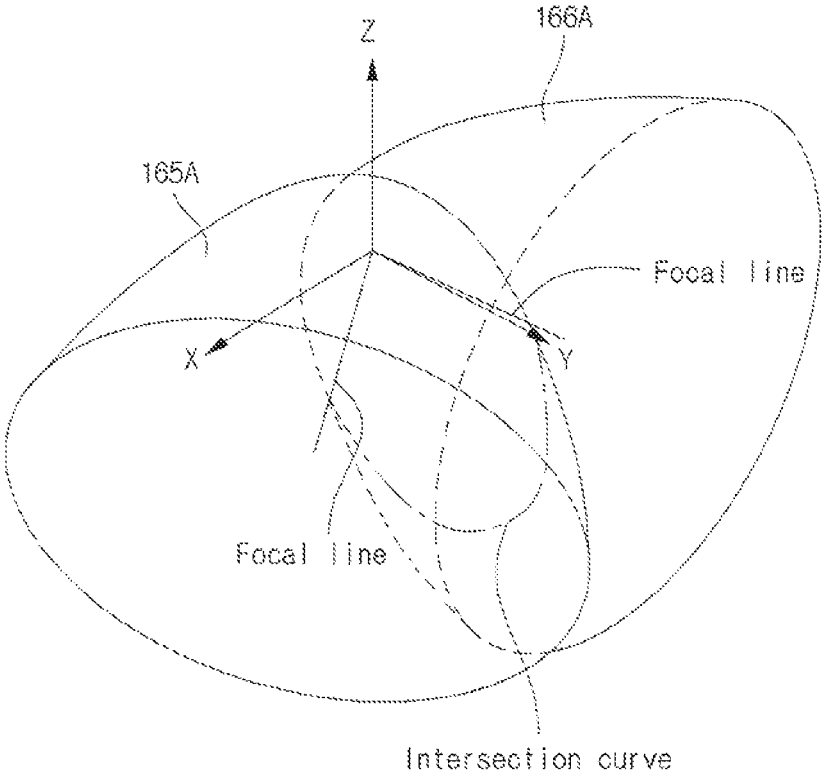
FIGS. 16 to 22 are views to explain the manufacturing process of a reflective surface of the reflective cover in the lighting module according to the embodiment.
Figure 17:
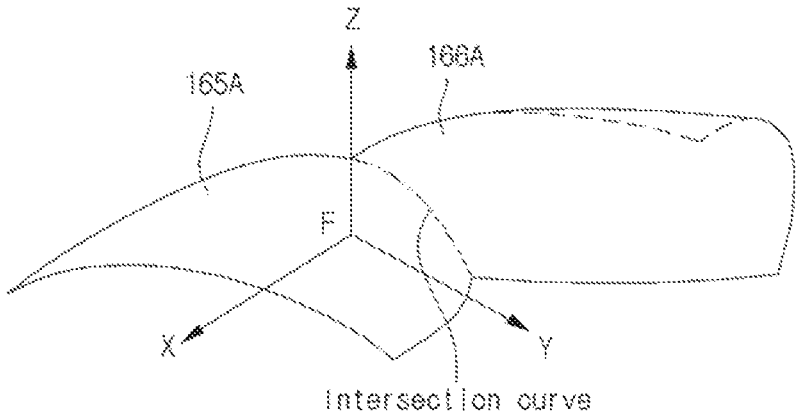

As shown in FIG. 16, after allowing parabolic surfaces 165A and 166A to be symmetrical to each other about a ZY plane, the parabolic surfaces 165A and 166A are allowed to be adjacent to focal lines which are boundary areas symmetrical to each other. If an intersection curve is removed from the two parabolic surfaces 165A and 166A, two parabolic surfaces 165A and 166A are formed to divide light emitted from an origin F. If mechanically overlapped areas are removed from the above shape, the reflective surfaces have the parabolic surfaces 165A and 166A shown in FIG. 17. The two parabolic surfaces 165A and 166A divide the light emitted from the origin F. In addition, each of the parabolic surfaces 165A and 166A may collect light in a direction in which the focal line is oriented. In this case, the Y axis direction may be a front direction, and a negative Z axis direction may be a bottom direction.

Figure 18:
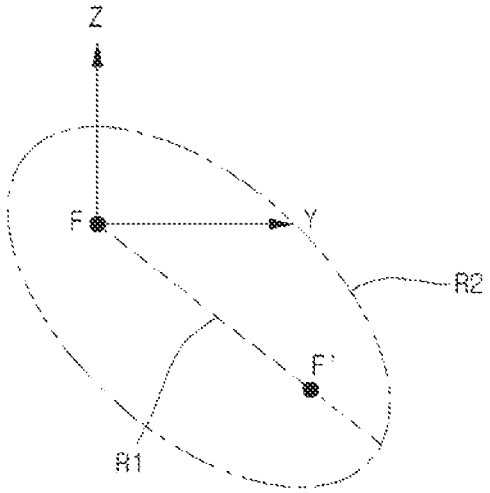
Figure 19:
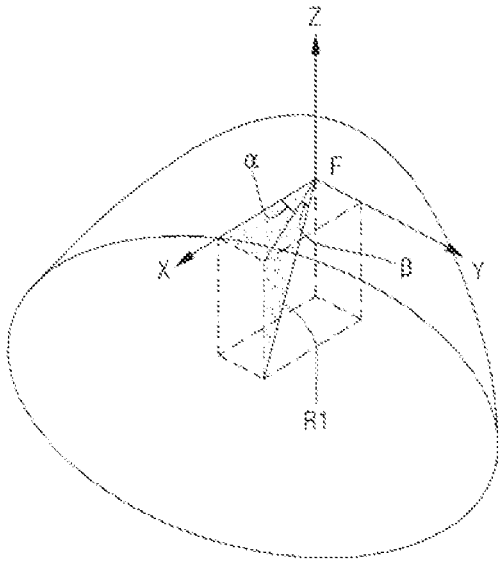

As shown in FIGS. 18 and 19, the intersection curve in which the parabolic surfaces 165A and 166A intersect on the ZY plane have an oval characteristic.

The oval may be shown in the shape of an oval R2 having the origin F, at which the light source part is positioned, as a focus. An oval R2 has another focus F' on a focal line R1 projected onto the ZY plane. A linear segment formed by points F and F' on the focal line R1 has a second angle β formed from a Y axis.

As shown in FIG. 19, the focal line serving as a basis to form a parabolic surface may form a predetermined angle so that the light is divided left and right areas and progressed to downward direction. A first angle α on an XY plane forms a predetermined line, and the focal line R1 is formed with the second angle β on a predetermined plane formed by the focal line R1 and the Z axis. Accordingly, a predetermined parabolic surface may be created based on the focal line and the origin F.

Figure 23:
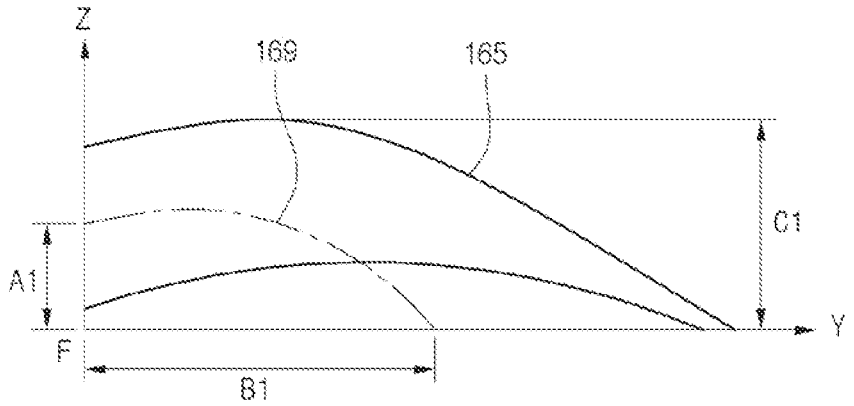
FIG. 23 is a sectional view schematically showing the reflective cover in the lighting module according to the embodiment.
Figure 24:
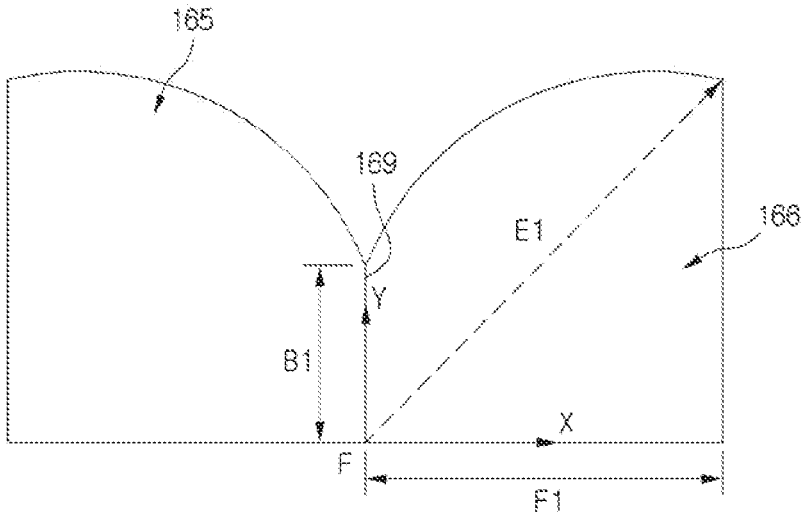
FIG. 24 is a bottom view schematically showing the reflective cover according to the embodiment.

Regarding the focal line R1 and the first and second angles α and β to form the parabolic surface, the first angle α has the range of 20°≤α≤40°. If the first angle α is less than 20°, light loss significantly occurs in upper area of left and right regions. If the first angle α exceeds 40°, the effect to divide light left and right areas is reduced. The second angle β has the range of 40°≤β≤70°. If the second angle β is less than 40°, light loss significantly occurs in upper of left and right areas. If the second angle β exceeds 70°, an amount of light progressing to downward direction is increased, so that the effect to progress the light forward area can be reduced. As shown in FIGS. 23 and 24, a ratio among A1, B1, and E1 may be affected by the focal line and the first and second angles α and β to form the focal surfaces. For example, the first and second angles α and β may be a value in a range for light distribution to progress light to a front lower portion and divide the light left and right areas, which is characterized in a lighting apparatus such as a street lamp.

Figure 20:
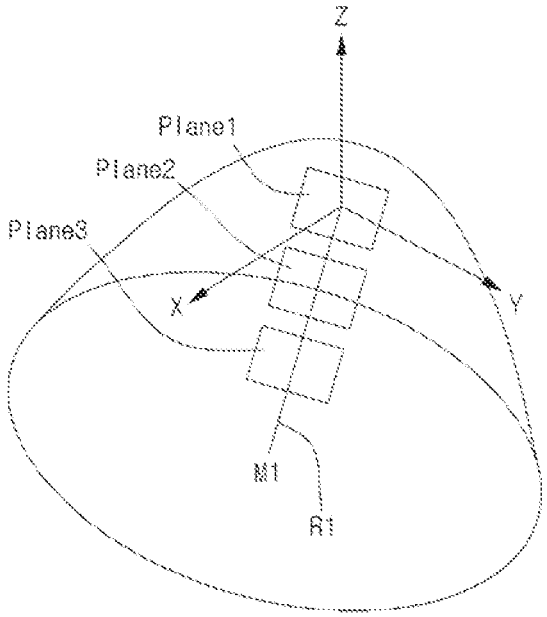
Figure 21:
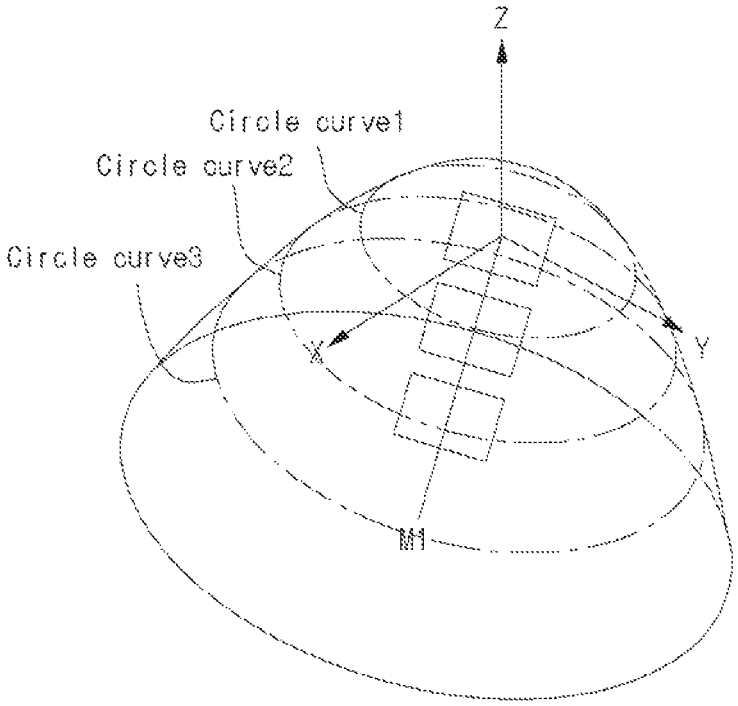
Figure 22:
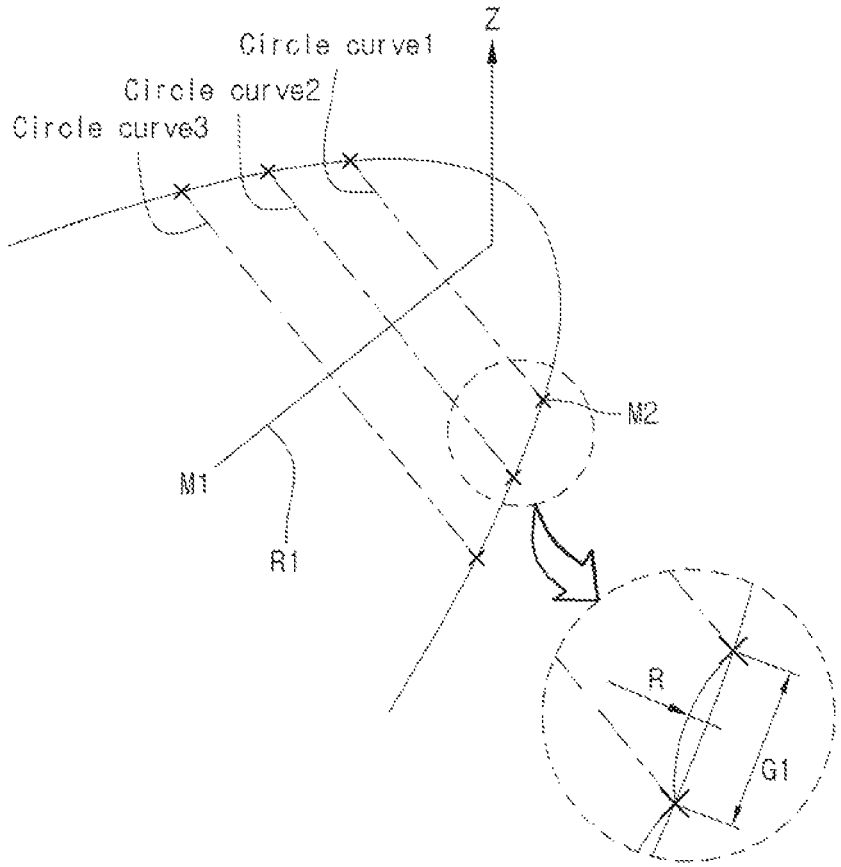

Referring to FIGS. 20 to 22, light concentrated in a direction M1 oriented by the focal line R1 has strong straightness, so that the light is not appropriate to light distribution in the lighting apparatus such as the street lamp. Accordingly, the parabolic surface is deformed to provide a predetermined curvature so that the straightness of the light can be reduced.

As shown in FIG. 21, if a plurality of planes are created in parallel to each other along the focal line R1, a plurality of circle curves at which the planes and the parabolic surface intersect may be formed. As shown in FIG. 22, intersections M2 between the parabolic surface and the circle curves are formed on a plane formed by the focal line R1 and the Z axis. In this case, if a curve (that is, sub-reflective surface) having a predetermined curvature R is created between adjacent intersects M2, a plurality of sub-reflective surfaces may be formed. The effect in which the light is diffused by the reflective surface having the plural sub-reflective surface can be obtained. The interval between the intersections M2 may be a width G1 between the sub-reflective surfaces.

As shown in FIG. 22, if the sub-reflective surfaces are formed with the same curvature, the effect of diffusing light may be gradually reduced farther away from the origin. Accordingly, the curvature of the sub-reflective surface may be gradually reduced as the sub-reflective surface is farther away from the origin. The sub-reflective surface increases the diffusion of the light as the sub-reflective surface is farther away from the origin, so that the degree of the uniformity of the light can be improved.

FIG. 23 is a side view showing the reflective surface according to the embodiment, and FIG. 24 is a bottom view showing the reflective surface.

As shown in FIG. 23, the intersection curves on the ZY plane have the following condition. The height A1 from the origin F in a height direction (Z axis) is a distance between the origin F, at which the light source part is provided, and the separation part 169, and has the range of 10 mm≤A1≤20 mm. If the height A1 exceeds the value in the range, the effect of diffusing the light is reduced. If the height A1 is less than the value in the range, the straightness of the light may be increased. The width B1 in a length (Y axis) direction from the origin F is a distance between the origin F and the separation part 169, and has the range of 30 mm≤B1≤50 mm. If the width B1 exceeds the value in the range, the straightness of the light may be increased. If the width B1 is less than the value in the range, a greater amount of light may be diffused left and right areas. The ratio of the height A1 to the width B1 may be in the range of 1:2.5 to 1:3.

The height of the apex of the reflective surface 165 in the height direction (Z axis) has the following condition. The apex height of the reflective surface 165 is a distance from the origin F in a vertical direction, and the height C1 has a range of 20 mm≤C1≤35 mm. If the height C1 is less than or exceeds the value in the range, the light reflectance may be degraded. If the height C1 is less than the value in the range, the effect of diffusing the light may be reduced.

Referring to FIG. 24, regarding the reflective surfaces 165 and 166 on the YZ plane, the length F1 in the length direction (X axis) from the origin F may have the range of 100 mm≤F1≤120 mm, and the length F1 may be a length of each of the reflective surfaces 165 and 166. The ratio of the width B1 to the length F1 may be in the range of 1:2.4 to 1:3.5. On each of the reflective surfaces 165 and 166, the longest length E1 formed in a diagonal direction from the origin may have the range of 130 mm≤E1≤150 mm. If the longest length E1 is less than the value of the range or exceeds the value of the range, the effect of diffusing the light through left and right directions or the straightness may be degraded. The ratio of the length F1 to the longest length E1 may be in the range of 1:1.25 to 1:1.3. The longest length E1 has a length longer than that of the length F1, so that the light diffusion effect through left and right direction can be improved.

Figure 25:
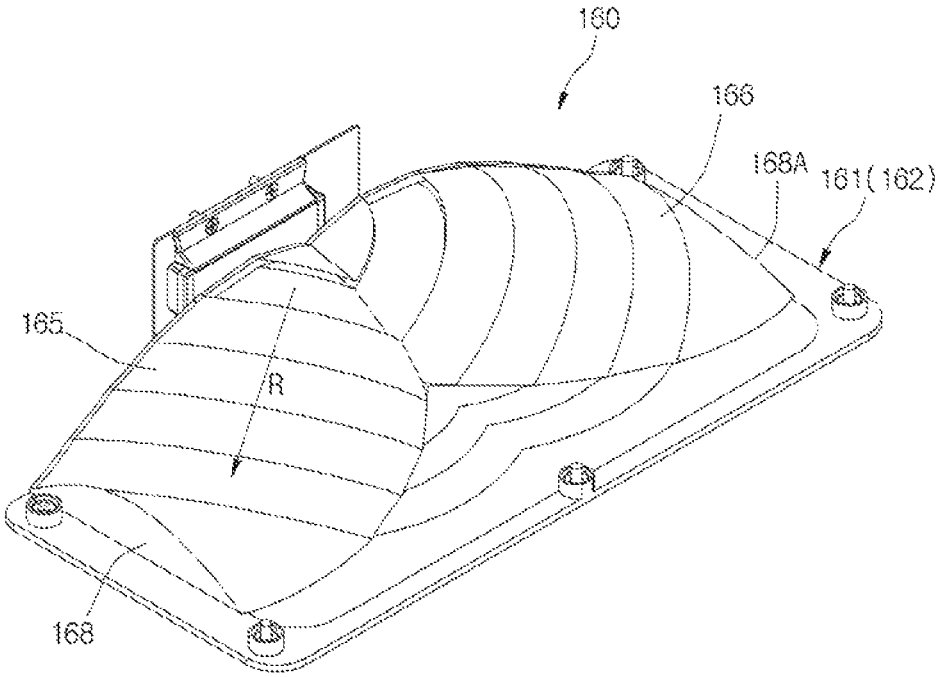
FIG. 25 is a perspective view showing an outer appearance of the reflective cover in the lighting module according to the embodiment.

Referring to FIG. 25, outer surfaces of the reflective surfaces 165 and 166 may be provided in the form of parabolic surfaces so that each sub-reflective surface has a predetermined curvature R.

Figure 26:
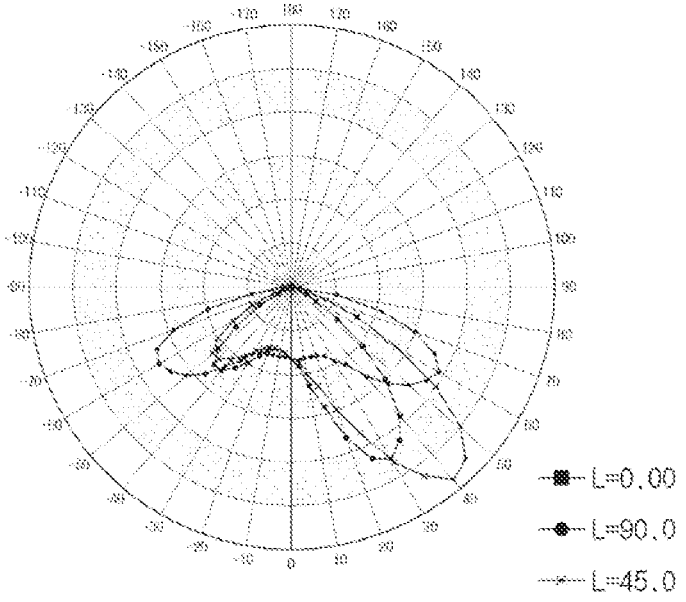
FIG. 26 is a view showing the comparison in illuminance distribution between the front and rear sides of the lighting module according to the embodiment and the comparative example.
Figure 26:
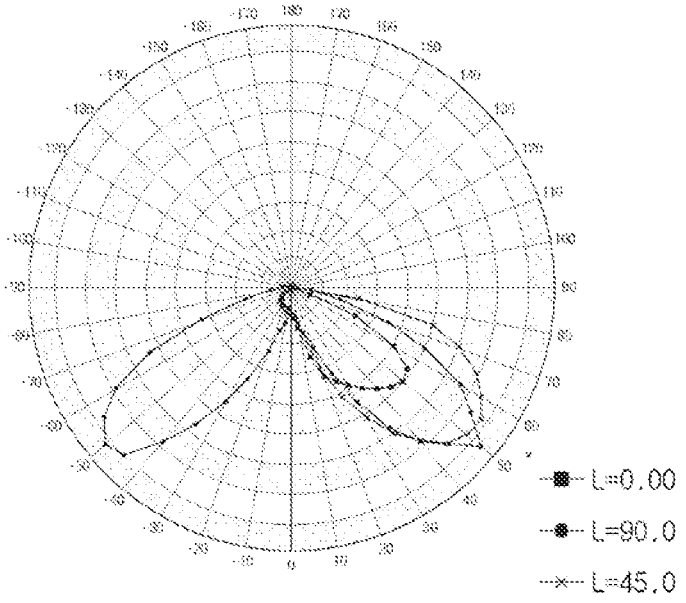

FIG. 26 is a view showing the comparison between intensity slides in the light distribution according to the embodiment and the comparative example.

Referring to FIG. 26, in the light distribution, a left area of a vertical axis represents the illuminance intensity of light irradiated to a rear side, and a right area of the vertical axis represents the illuminance intensity of light irradiated to a front side. According to the comparative example, illuminance intensity having a predetermined size occurs at the rear side when viewed from the vertical axis (L=0.00). According to the embodiment, the illuminance intensity hardly occurs at the rear side when viewed from the vertical axis (L=0.00). In this case, the L=0.00 represents an angle between the vertical axis and the separation part between the first and second reflective surfaces, L=90.0 represents an angle between a horizontal axis and the first and second reflective surfaces, and L=45.0 represents an area positioned in a direction of 45° from the separation part.

Figure 27:
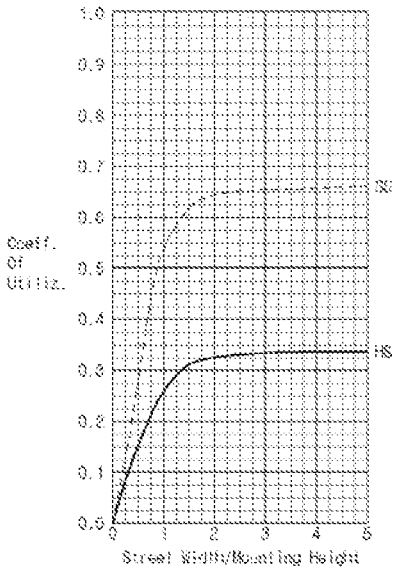
FIG. 27 is a view showing the comparison in light distribution between the front and the rear sides of the lighting modules according to the embodiment and the comparative example.
Figure 27:
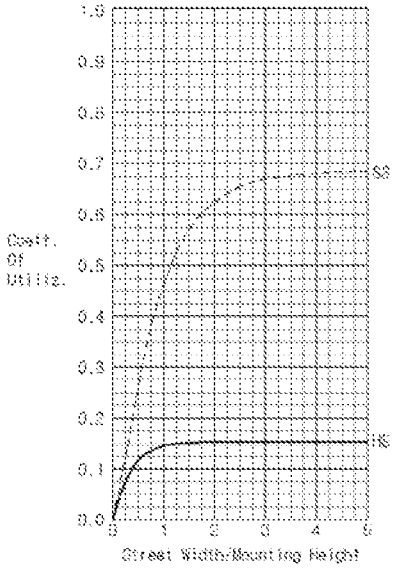

FIG. 27 is a graph showing in a comparison result (coefficient of utilize) between amounts of light at the front and the rear sides according to the comparative example and the embodiment. In this case, an X axis direction represents a ratio of a street width/mounting height. The front side may be a street side (SS) and the rear side may be a house side (HS) in the case of the lamp apparatus, such as a street lamp, Referring to FIG. 27, the comparison result between amounts of light distributed at the front and rear sides is provided. In the comparison result between the amounts of the light distributed at the front and rear sides according to the comparative example, an amount of light at the rear side is ½ of an amount of light at the front side. In other words, a great amount of light is irradiated to the rear side. In the comparison result between the amounts of the light distributed at the front and rear sides according to the embodiment, an amount of light at the rear side is ¼ or less of an amount of light at the front side. In other words, the distribution of light irradiated to the rear side is ¼ or less of the distribution of light irradiated to the front side.

Figure 28:
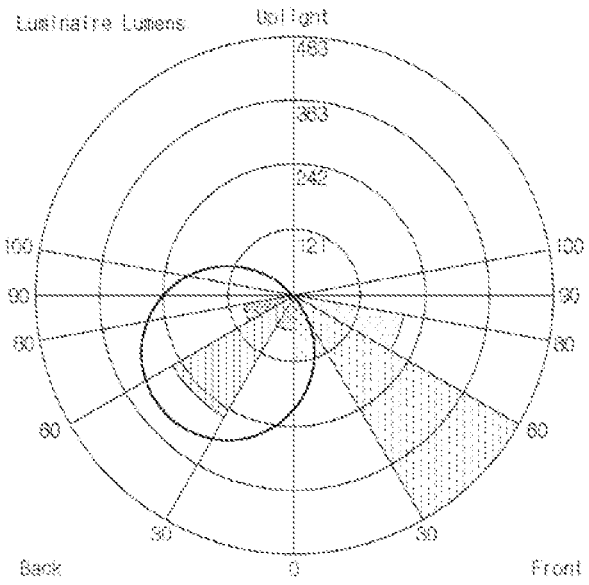
FIG. 28 is a view showing the comparison between luminaire classification systems (LCS) of the lighting modules according to the embodiment and the comparative example.
Figure 28:
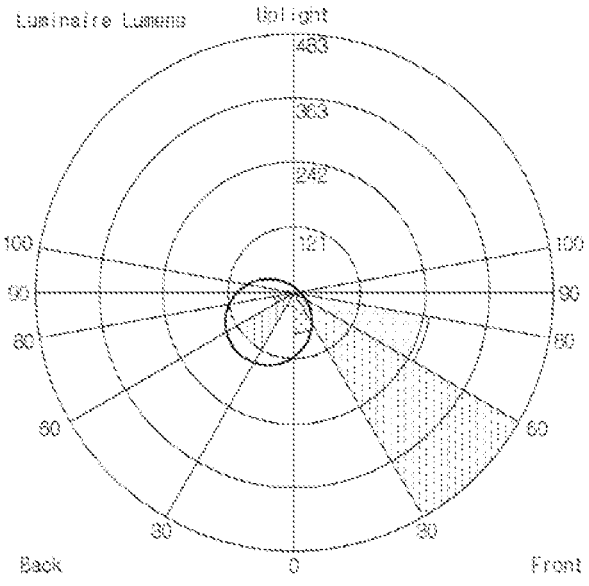

FIG. 28 is a view showing a luminaire classification system (LCS) in lighting apparatuses according the comparative example and the embodiment.

Referring to FIG. 28, according to the comparative example, a great amount of light is irradiated to a rear side as shown in that in a solid line circle. According to the embodiment, light is irradiated to the rear side in amount less than the amount of the light according to the embodiment as shown in that in a solid line circle. In other words, according to the embodiment, the light progressing to the rear side direction is almost blocked, so that the light pollution can be removed from the rear side direction.

According to the embodiment, the lighting module can reduce the light leaking in a rear direction.

According to the embodiment, the lighting module can diffuse the light emitted from the light source part in the left-right direction and the straightness direction.

According to the embodiment, the light can be uniformly divided to both side areas using the reflective cover of the lighting module.

The embodiment can provide a street lamp capable of preventing light pollution.

According to the embodiment, an additional shield or an additional field to block light progressing to the rear side direction may not be disposed.

In addition, the reliability of the lighting module according to the embodiment and the lighting apparatus having the same can be improved.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A lighting module comprising:

a bottom part comprising a bottom cover having a transmission hole;

a top cover provided on the bottom cover and having a protrusion hole;

a reflective cover disposed between the bottom cover and the top cover, and having a parabolic surface to reflect incident light to the transmission hole;

a heat radiation plate having a heat radiation protrusion protruding through the protrusion hole of the top cover and provided on the top cover; and a light source part provided on one surface of the heat radiation protrusion and emitting light into the reflective cover, wherein the bottom part comprises:

a transparent cover on the transmission hole of the bottom cover; and a guide cover having a plurality of guide holes on the transparent cover.

2. The light module of claim 1, wherein the reflective cover comprises a plurality of reflective covers corresponding to the guide holes, respectively, and a light source part is provided in a rear portion of each reflective cover.

3. The lighting module of claim 1, wherein the top cover is provided a lower portion thereof with a receiving area to receive the reflective cover, and an upper portion of the top cover makes contact with a bottom surface of the heat radiation plate.

4. A lighting module comprising:

a bottom part comprising a bottom cover having a transmission hole;

a top cover provided on the bottom cover and having a protrusion hole;

a reflective cover disposed between the bottom cover and the top cover, and having a parabolic surface to reflect incident light to the transmission hole;

a heat radiation plate having a heat radiation protrusion protruding through the protrusion hole of the top cover and provided on the top cover; and a light source part provided on one surface of the heat radiation protrusion and emitting light into the reflective cover, wherein the reflective cover comprises:

a recess that is convex up;

a coupling hole provided at a rear portion of the reflective cover and coupled to the light source part;

first and second reflective surfaces on the recess; and a separation part disposed between the first and second reflective surfaces to disperse incident light to the first and second reflective surfaces.

5. The lighting module of claim 4, wherein the first reflective surface comprises a plurality of first sub-reflective surfaces having an origin at the light source part and having mutually different radiuses, the second reflective surface comprises a plurality of second sub-reflective surfaces having the origin at the light source part and having mutually different radiuses, and the first and second sub-reflective surfaces have shapes of parabolic surfaces.

6. The lighting module of claim 5, wherein the first and second reflective surfaces are symmetrical to each other about the separation part.

7. The lighting module of claim 5, further comprising a third reflective surface provided at outer portions between the first and second reflective surfaces, wherein the third reflective surface comprises a plurality of third sub-reflective surfaces having a curvature different from curvatures of the first and second sub-reflective surfaces.

8. The lighting module of claim 7, wherein the light source part comprises:

a printed circuit board having a plurality of light emitting devices therein;

a guide case to guide light on the printed circuit board; and a diffusion plate on the guide case.

9. The lighting module of claim 7, wherein the first and second sub-reflective surfaces have the curvatures gradually reduced as the first and second sub-reflective surfaces are farther away from the light source part.

10. A lighting module comprising:

a light source part comprising a printed circuit board and a plurality of light emitting devices to emit light on the printed circuit board; and a reflective cover provided at a rear portion thereof with the light source part to reflect light incident from the light source part downward, wherein the reflective cover comprises:

a first reflective surface comprising a plurality of first sub-reflective surfaces having mutually different radiuses at a first area adjacent to an optical axis of the light emitting device;

a second reflective surface comprising a plurality of second sub-reflective surfaces having mutually different radiuses at a second area adjacent to the optical axis;

a separation part disposed between the first and second reflective surfaces while extending in a direction of the optical axis; and a third reflective surface having a plurality of third sub-reflective surfaces at outer portions of the first and second reflective surfaces.

11. The lighting module of claim 10, wherein the first and second reflective surfaces are symmetrical to each other with respect to the optical axis.

12. The lighting module of claim 11, wherein each of the first and second reflective surfaces has a shape of a parabolic surface.

13. The lighting module of claim 11, wherein the reflective cover comprises:

a coupling hole provided in a rear sidewall of the reflective cover and provided therein with the light emitting devices; and first and second blocking walls provided at outer portions of the first and second reflective surfaces.

14. The lighting module of claim 11, wherein the third sub-reflective surfaces have curvatures larger than curvatures of the first and second sub-reflective surfaces.

15. The lighting module of claim 13, wherein a plurality of reflective covers spaced apart from each other and a plurality of light source parts spaced apart from each other are provided.

16. The lighting module of claim 11, wherein the first and second sub-reflective surfaces have surface areas gradually widened as the first and second sub-reflective surfaces are farther away from the light source.

17. The lighting module of claim 11, wherein a portion of the separation part adjacent to the light source part is higher than a position of the light source part and lower than apexes of the first and second reflective surfaces.

18. The lighting module of claim 17, wherein the separation part is provided at a position gradually lowered as the separation part is farther away from the light source part.

19. The lighting module of claim 17, wherein the separation part is connected with a boundary area between the first and third reflective surfaces and a boundary area between the second and third reflective surfaces.

20. The lighting module of claim 4, wherein the bottom part comprises:

a transparent cover on the transmission hole of the bottom cover; and a guide cover having a plurality of guide holes on the transparent cover, and wherein the reflective cover comprises a plurality of reflective covers corresponding to the guide holes, respectively, and a light source part is provided in a rear portion of each reflective cover.

* * * * *